US012366393B2

(12) United States Patent
Foran

(10) Patent No.: US 12,366,393 B2
(45) Date of Patent: Jul. 22, 2025

(54) FLASH VOLUME SYSTEM

(71) Applicant: Carrier Corporation, Palm Beach Gardens, FL (US)

(72) Inventor: Aaron Foran, Cicero, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 141 days.

(21) Appl. No.: 18/311,481

(22) Filed: May 3, 2023

(65) Prior Publication Data

US 2023/0358453 A1 Nov. 9, 2023

Related U.S. Application Data

(60) Provisional application No. 63/339,751, filed on May 9, 2022.

(51) Int. Cl.
*F25B 43/00* (2006.01)

(52) U.S. Cl.
CPC ..... *F25B 43/006* (2013.01); *F25B 2400/13* (2013.01)

(58) Field of Classification Search
CPC ..... F25B 43/006; F25B 2400/13; F25B 2400/23; F25B 2400/16; F25B 2400/161; F25B 2313/001; F25B 2339/0442; F25B 39/028
See application file for complete search history.

(56) References Cited

U.S. PATENT DOCUMENTS 2,867,099 A 1/1959 Schubert
4,364,242 A 12/1982 Smith
2015/0219379 A1 8/2015 Sun et al.
2021/0239366 A1 * 8/2021 Auyer ..... F25B 1/10

FOREIGN PATENT DOCUMENTS

DE 3511421 A1 10/1986
DE 20208658 U1 * 8/2002 ..... G06F 1/20
JP H05223383 A 8/1993

OTHER PUBLICATIONS

English translation of Neolect Components (DE-20208658-U1). (Year: 2002).*
Extended European Search Report for European Application No. 23172453.5; Report Mail Date Oct. 12, 2023 (6 pages).

* cited by examiner

*Primary Examiner* — Miguel A Diaz
(74) *Attorney, Agent, or Firm* — CANTOR COLBURN LLP

(57) ABSTRACT

A refrigerant vapor compression system includes a refrigerant circuit having a compressor, a heat rejection heat exchanger, a heat absorption heat exchanger and a main expansion device arranged between the heat rejection heat exchanger and the heat absorption heat exchanger relative to a flow of refrigerant. A secondary expansion device is disposed downstream from the heat rejection heat exchanger and a flash tank assembly is disposed downstream from the heat rejection heat exchanger. The flash tank assembly includes a first header arranged downstream from and in fluid communication with the second expansion device, a second header arranged upstream from and in fluid communication with the main expansion device, and a plurality of tanks connected at a first end to the first header and at a second end to the second header. A load of the flash tank assembly is equally balanced between each of the plurality of tanks.

20 Claims, 6 Drawing Sheets

FLASH VOLUME SYSTEM

CROSS-REFERENCE TO RELATED APPLICATIONS

This application claims the benefit of U.S. Application No. 63/339,751, filed May 9, 2022, the contents of which are incorporated by reference herein in their entirety.

BACKGROUND

Exemplary embodiments of the present disclosure relate to the art of transport refrigeration systems, and more particularly, to a flash tank volume of a transport refrigeration system.

Refrigerant vapor compression systems are commonly used in mobile refrigeration systems, such as transport refrigeration systems, for refrigerating air or other gaseous fluid supplied to a temperature controlled cargo space of a truck, trailer, container, or the like, for transporting perishable items, fresh or frozen, by truck, rail, ship or intermodal.

Conventional refrigerant vapor compression systems used in transport refrigeration systems typically include a compressor, a refrigerant heat rejection heat exchanger, and a refrigerant heat absorption heat exchanger arranged in a closed loop refrigerant circuit. An expansion device, commonly an expansion valve, is disposed in the refrigerant circuit upstream, with respect to refrigerant flow, of the refrigerant heat absorption heat exchanger and downstream of the refrigerant heat rejection heat exchanger. These basic refrigerant vapor compression system components are interconnected by refrigerant lines and are arranged in accord with known refrigerant vapor compression cycles. Refrigerant vapor compression systems may be operated in either a subcritical pressure regime or a transcritical pressure regime depending upon the particular refrigerant in use.

Different types of refrigeration systems may utilize different refrigerants and operate at different pressures. One type of refrigeration system is a transcritical refrigeration system that may use CO2 as a refrigerant (e.g., R-744). Such systems typically operate at high pressures which may range from 1000 psi to 1800 psi. The higher the operating pressure, the higher may be the risk of a refrigerant leak. All refrigeration systems are sensitive to loss of refrigerant charge and may lose operating efficiency or cease operating altogether.

BRIEF DESCRIPTION

According to an embodiment, a refrigerant vapor compression system includes a refrigerant circuit having a compressor, a heat rejection heat exchanger, a heat absorption heat exchanger and a main expansion device arranged between the heat rejection heat exchanger and the heat absorption heat exchanger relative to a flow of refrigerant. A secondary expansion device is disposed downstream from the heat rejection heat exchanger and a flash tank assembly is disposed downstream from the heat rejection heat exchanger. The flash tank assembly includes a first header arranged downstream from and in fluid communication with the second expansion device, a second header arranged upstream from and in fluid communication with the main expansion device, and a plurality of tanks connected at a first end to the first header and at a second end to the second header. A load of the flash tank assembly is equally balanced between each of the plurality of tanks.

In addition to one or more of the features described herein, or as an alternative, further embodiments each of the plurality of tanks is substantially identical.

In addition to one or more of the features described herein, or as an alternative, further embodiments the plurality of tanks are formed from a copper material.

In addition to one or more of the features described herein, or as an alternative, further embodiments the plurality of tanks are formed from an aluminum material.

In addition to one or more of the features described herein, or as an alternative, further embodiments at least one of the plurality of tanks is a tube.

In addition to one or more of the features described herein, or as an alternative, further embodiments the plurality of tanks extend vertically between the first header and the second header.

In addition to one or more of the features described herein, or as an alternative, further embodiments the plurality of tanks are arranged in a linear configuration.

In addition to one or more of the features described herein, or as an alternative, further embodiments the plurality of tanks are arranged in rows and the tanks within adjacent rows are aligned.

In addition to one or more of the features described herein, or as an alternative, further embodiments the plurality of tanks are arranged in rows and the tanks within adjacent rows are staggered.

In addition to one or more of the features described herein, or as an alternative, further embodiments the compressor comprises a single compressor having a plurality of compressor stages.

In addition to one or more of the features described herein, or as an alternative, further embodiments the compressor further comprises a plurality of compressors arranged in series relative to the flow of refrigerant.

According to an embodiment, a flash tank assembly for a refrigerant vapor compression system is provided. The refrigerant vapor compression system includes a refrigerant circuit comprising a compressor, a heat rejection heat exchanger, a heat absorption heat exchanger. The flash tank assembly is disposed downstream from the heat rejection heat exchanger and includes a first header arranged downstream from and in fluid communication with a second expansion device of the vapor compression system, a second header arranged upstream from and in fluid communication with a main expansion device of the vapor compression system, and a plurality of tanks connected at a first end to the first header and at a second end to the second header. A load of the flash tank assembly is equally balanced between each of the plurality of tanks.

In addition to one or more of the features described herein, or as an alternative, further embodiments each of the plurality of tanks is substantially identical.

In addition to one or more of the features described herein, or as an alternative, further embodiments the plurality of tanks are formed from a copper material.

In addition to one or more of the features described herein, or as an alternative, further embodiments the plurality of tanks are formed from an aluminum material.

In addition to one or more of the features described herein, or as an alternative, further embodiments at least one of the plurality of tanks is a tube.

In addition to one or more of the features described herein, or as an alternative, further embodiments the plurality of tanks extend vertically between the first header and the second header.

In addition to one or more of the features described herein, or as an alternative, further embodiments the plurality of tanks are arranged in a linear configuration.

In addition to one or more of the features described herein, or as an alternative, further embodiments the plurality of tanks are arranged in rows and the tanks within adjacent rows are aligned.

In addition to one or more of the features described herein, or as an alternative, further embodiments the plurality of tanks are arranged in rows and the tanks within adjacent rows are staggered.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
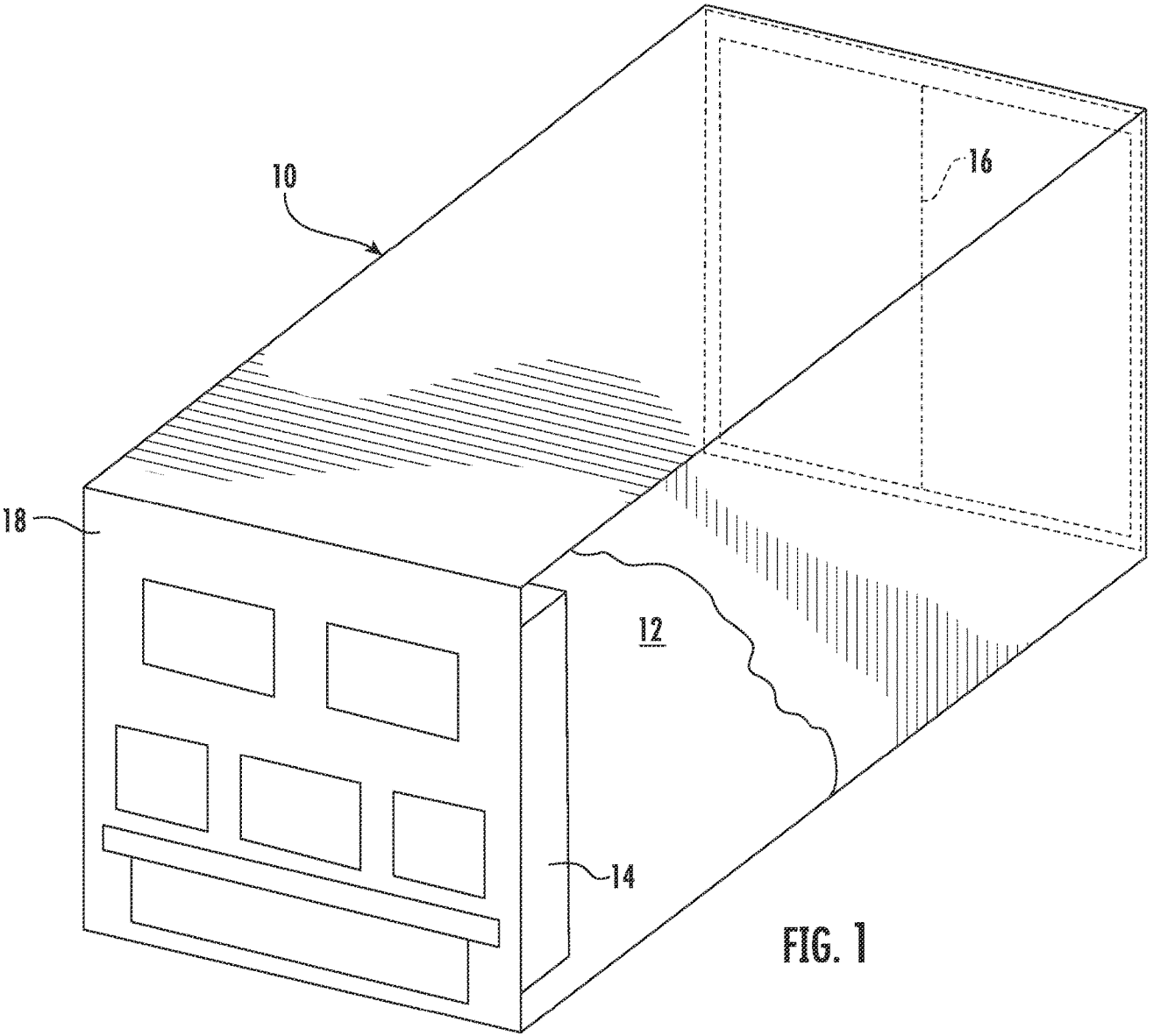
FIG. 1 is a perspective view of an exemplary refrigerated container utilizing a transport refrigeration system according to an embodiment.

FIG. 1 depicts a refrigerated container 10 having a temperature controlled cargo space 12, the atmosphere of which is refrigerated by operation of a transport refrigeration unit 14 associated with the cargo space 12. In the depicted embodiment of the refrigerated container 10, the transport refrigeration unit 14 is mounted in a wall of the refrigerated container 10, typically in the front wall 18 in conventional practice. However, the transport refrigeration unit 14 may be mounted in the roof, floor, or other walls of the refrigerated container 10. Additionally, the refrigerated container 10 has at least one access door 16 through which perishable goods, such as, for example, fresh or frozen food products, may be loaded into and removed from the cargo space 12 of the refrigerated container 10.

Figure 2:
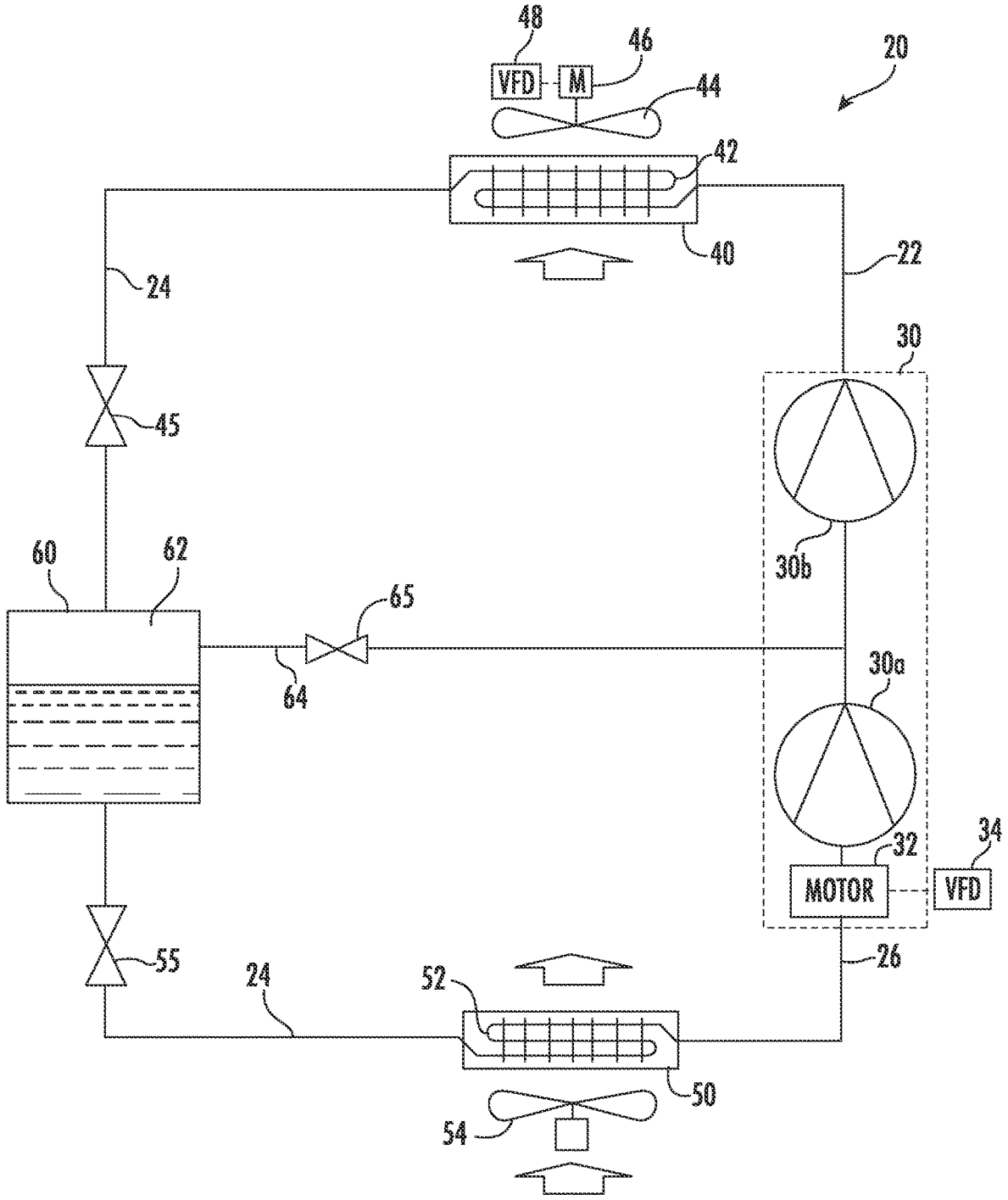
FIG. 2 is a schematic diagram representing an exemplary transport refrigeration system according to an embodiment.
Figure 3A:
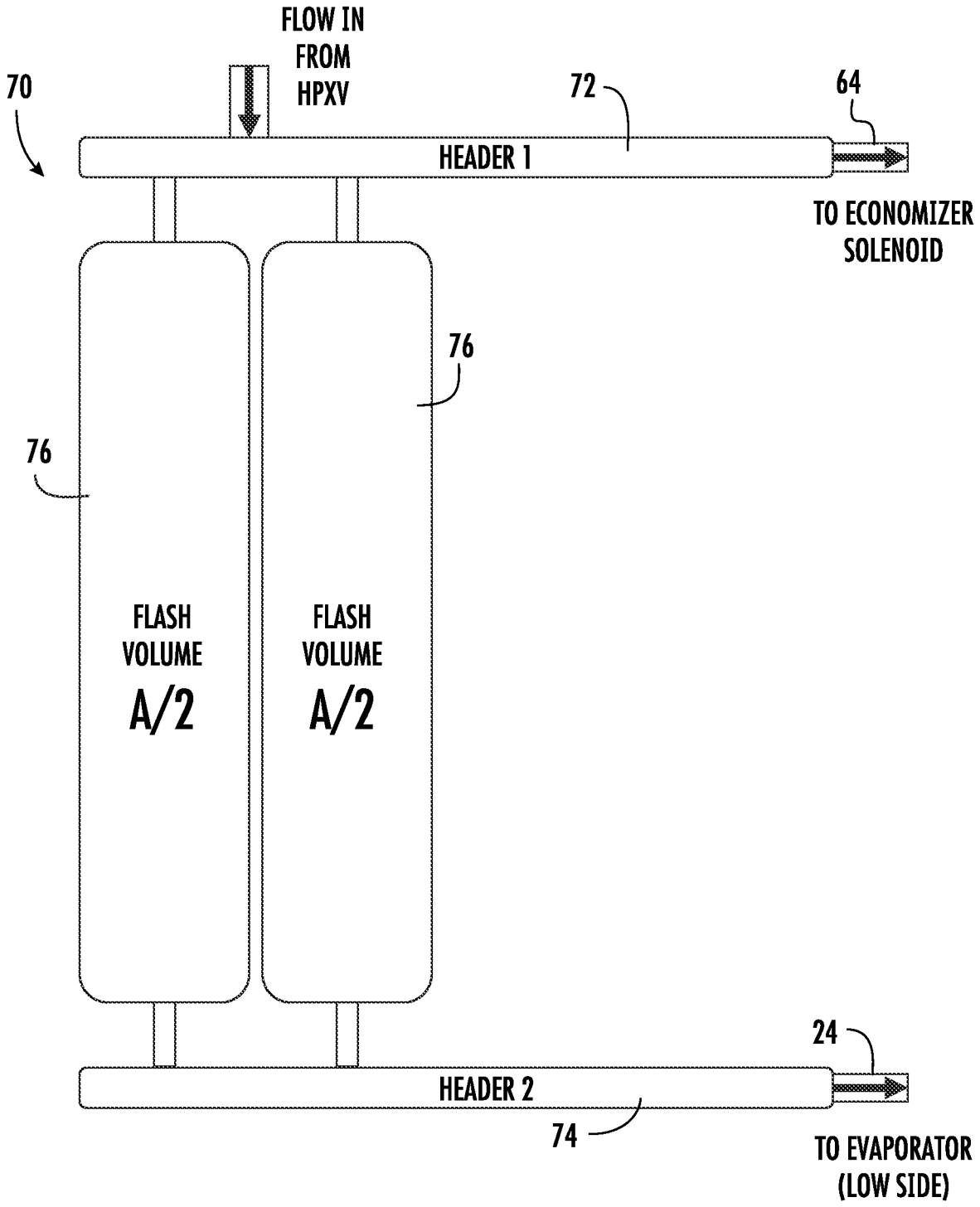
FIG. 3A-3C are front views of exemplary flash tank assemblies of a transport refrigeration system according to various embodiments.
Figure 3B:
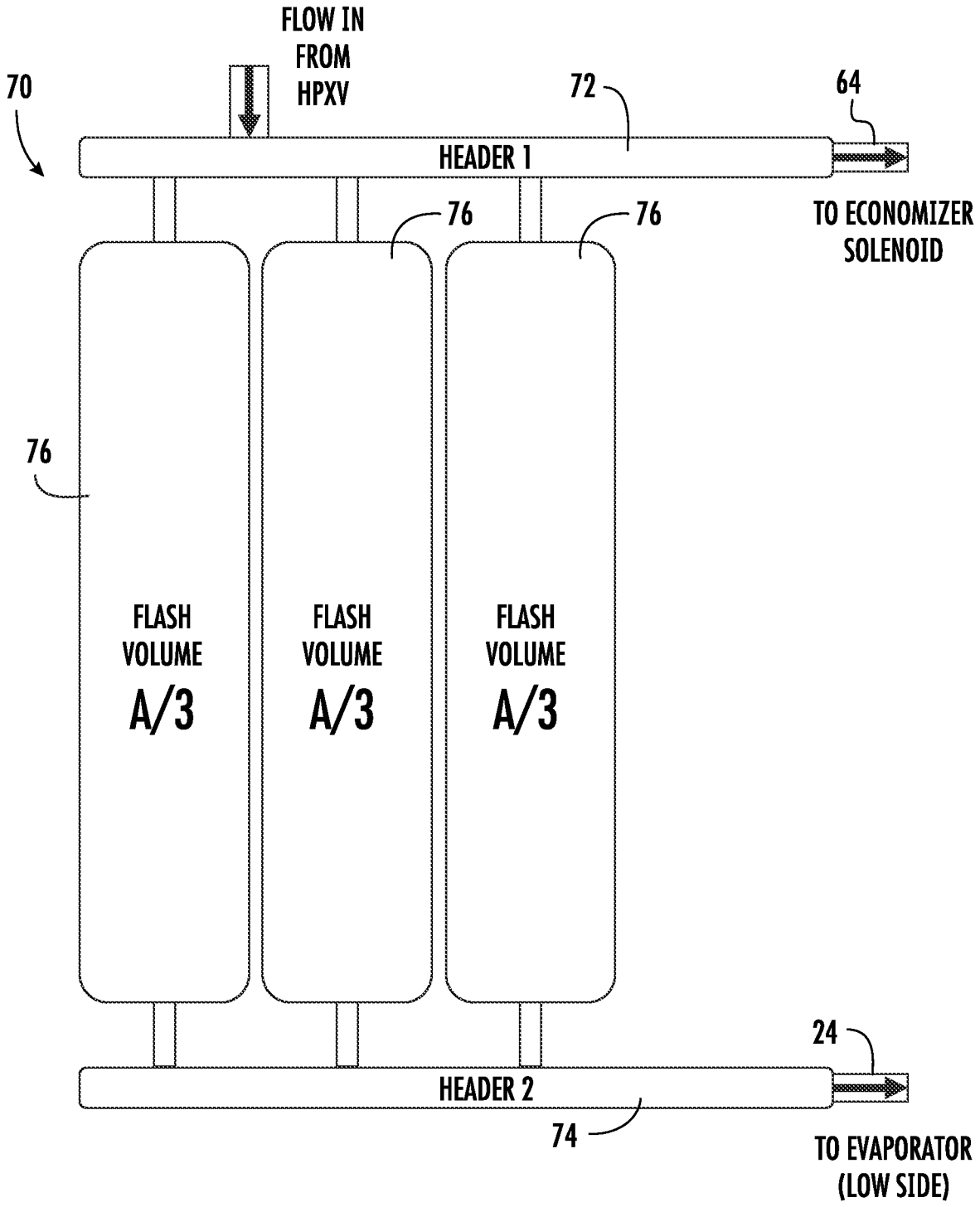
Figure 3C:
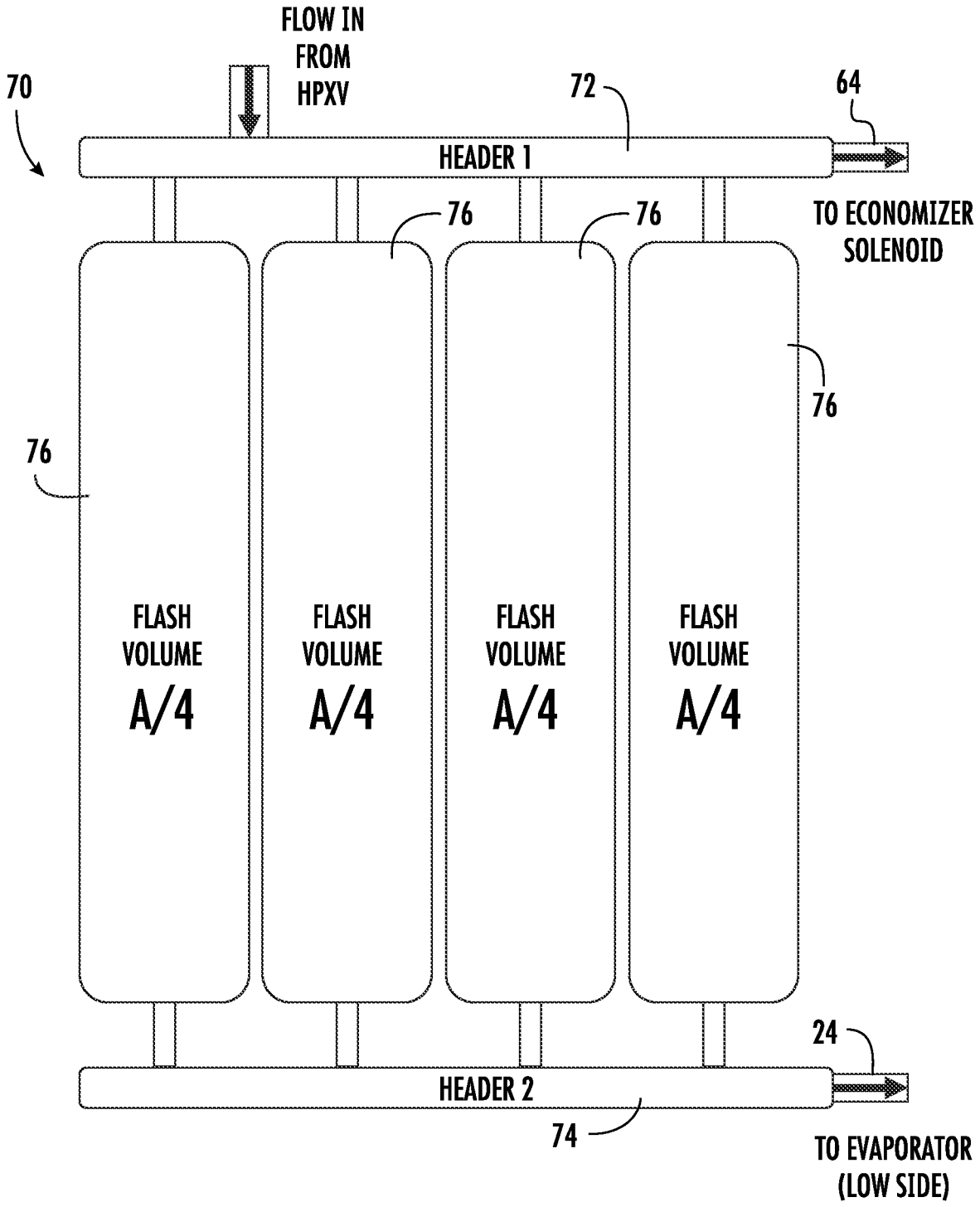

With reference now to FIG. 2, a schematic diagram of a transport refrigeration system 20 suitable for use in the transport refrigeration unit 14 for refrigerating air drawn from and supplied back to the temperature controlled cargo space 12 is illustrated. Although the transport refrigeration system 20 will be described herein in connection with a refrigerated container 10 of the type commonly used for transporting perishable goods by ship, by rail, by land, or intermodally, it is to be understood that the transport refrigeration system 20 may also be used in transport refrigeration units for refrigerating the cargo space of a truck, a trailer, or the like for transporting perishable fresh or frozen goods. The transport refrigeration system 20 is also suitable for use in conditioning air to be supplied to a climate controlled comfort zone within a residence, office building, hospital, school, restaurant, or other facility. The transport refrigeration system 20 could also be employed in refrigerating air supplied to display cases, merchandisers, freezer cabinets, cold rooms, or other perishable and frozen product storage areas in commercial establishments.

The transport refrigeration system 20 may include a compressor 30, that may be multi-stage, a heat rejection heat exchanger 40, a flash tank 60, a heat absorption heat exchanger 50, and refrigerant lines 22, 24 and 26 connecting the aforementioned components in a serial refrigerant flow order in a primary refrigerant circuit. A secondary expansion device 45, such as, for example, an electronic expansion valve, is disposed in refrigerant line 24 upstream of the flash tank 60 and downstream of the heat rejection heat exchanger 40. A main or primary expansion device 55, such as, for example, an electronic expansion valve, operatively associated with the heat absorption heat exchanger 50, is disposed in refrigerant line 24 downstream of the flash tank 60 and upstream of the heat absorption heat exchanger 50.

The compressor 30 functions to compress the refrigerant and to circulate refrigerant through the primary refrigerant circuit, and may be a single, multiple-stage refrigerant compressor (e.g., a reciprocating compressor or a scroll compressor) having a first compression stage 30*a* and a second stage 30*b*, wherein the refrigerant discharging from the first compression stage 30*a* passes to the second compression stage 30*b* for further compression. Alternatively, the compressor 30 may comprise a pair of individual compressors, one of which constitutes the first compression stage 30*a* and other of which constitutes the second compression stage 30*b*, connected in series refrigerant flow relationship in the primary refrigerant circuit via a refrigerant line connecting the discharge outlet port of the compressor constituting the first compression stage 30*a* in refrigerant flow communication with the suction inlet port of the compressor constituting the second compression stage 30*b* for further compression. In an embodiment including two compressors, the compressors may be scroll compressors, screw compressors, reciprocating compressors, rotary compressors, or any other type of compressor or a combination of any such compressors. In both embodiments, in the first compression stage 30*a*, the refrigerant vapor is compressed from a lower pressure to an intermediate pressure and in the second compression stage 30*b*, the refrigerant vapor is compressed from an intermediate pressure to higher pressure.

The compressor 30 may be driven by a variable speed motor 32 powered by electric current delivered through a variable frequency drive 34. The electric current may be supplied to the variable speed drive 34 from an external power source (not shown), such as for example a ship board power plant, or from a fuel-powered engine drawn generator unit, such as a diesel engine driven generator set, attached to the front of the container. The speed of the variable speed compressor 30 may be varied by varying the frequency of the current output by the variable frequency drive 34 to the variable speed motor 32. It is to be understood, however, that the compressor 30 could in other embodiments comprise a fixed speed compressor.

The heat rejection heat exchanger 40 may comprise a finned tube heat exchanger 42 through which hot, high pressure refrigerant discharged from the second compression stage 30*b* passes in heat exchange relationship with a secondary fluid, most commonly ambient air drawn through the heat rejection heat exchanger 40 by the fan(s) 44. The heat rejection heat exchanger 40 may comprise, for example, a fin and round tube heat exchange coil or a fin and flat mini-channel tube heat exchanger. In the depicted embodiment, a variable speed motor 46 powered by a variable frequency drive 48 drives the fan(s) 44 associated with the heat rejection heat exchanger 40.

When the transport refrigeration system 20 operates in a transcritical cycle, the pressure of the refrigerant discharging from the second compression stage 30*b* and passing through the heat rejection heat exchanger 40, referred to herein as the high side pressure, exceeds the critical point of the refrigerant, and the heat rejection heat exchanger 40 functions as a gas cooler. In an example embodiment, the refrigerant is carbon dioxide, also known as R744. However, it should be understood that if the transport refrigeration system 20 operates solely in the subcritical cycle, the pressure of the refrigerant discharging from the compressor 30 and passing through the heat rejection heat exchanger 40 is below the critical point of the refrigerant, and the heat rejection heat exchanger 40 functions as a condenser.

The heat absorption heat exchanger 50 may also comprise a finned tube coil heat exchanger 52, such as a fin and round tube heat exchanger or a fin and flat, mini-channel tube heat exchanger. Whether the refrigeration system 20 is operating in a transcritical cycle or a subcritical cycle, the heat absorption heat exchanger 50 functions as a refrigerant evaporator. Before entering the heat absorption heat exchanger 50, the refrigerant passing through refrigerant line 24 traverses the primary expansion device 55, such as, for example, an electronic expansion valve or a thermostatic expansion valve, and expands to a lower pressure and a lower temperature to enter heat absorption heat exchanger 50. As the liquid refrigerant traverses the heat absorption heat exchanger 50, the liquid refrigerant passes in heat exchange relationship with a heating fluid whereby the liquid refrigerant is evaporated and typically superheated to a desired degree. The low pressure vapor refrigerant leaving the heat absorption heat exchanger 50 passes through refrigerant line 26 to the suction inlet of the first compression stage 30*a*. The heating fluid may be air drawn by an associated fan(s) 54 from a climate controlled environment, such as a perishable/frozen cargo space associated with a transport refrigeration unit, or a food display or storage area of a commercial establishment, or a building comfort zone associated with an air conditioning system, to be cooled, and generally also dehumidified, and thence returned to a climate controlled environment.

In the illustrated, non-limiting embodiment, the flash tank 60, which is disposed in refrigerant line 24 between the heat rejection heat exchanger 40 and the heat absorption heat exchanger 50, upstream of the primary expansion device 55 and downstream of the secondary expansion device 45, functions as an economizer and a receiver. The flash tank 60 defines a chamber 62 into which expanded refrigerant having traversed the secondary expansion device 45 enters and separates into a liquid refrigerant portion and a vapor refrigerant portion. The liquid refrigerant collects in the chamber 62 and is metered therefrom through the downstream leg of refrigerant line 24 by the primary expansion device 55 to flow through the heat absorption heat exchanger 50.

The vapor refrigerant collects in the chamber 62 above the liquid refrigerant and may pass therefrom through economizer vapor line 64 for injection of refrigerant vapor into an intermediate stage of the compression process. A secondary expansion device or valve 65, such as, for example, a solenoid valve (ESV) having an open position and a closed position, is interposed in the economizer vapor line 64. When the transport refrigeration system 20 is operating in an economized mode, the secondary expansion device 65 is opened thereby allowing refrigerant vapor to pass through the economizer vapor line 64 from the flash tank 60 into an intermediate stage of the compressor 30. When the transport refrigeration system 20 is operating in a standard, non-economized mode, the secondary expansion device 65 is closed thereby preventing refrigerant vapor to pass through the economizer vapor line 64 from the flash tank 60 into an intermediate stage of the compressor 30.

In an embodiment where the compressor 30 has two compressors connected in serial flow relationship by a refrigerant line, one being a first compression stage 30*a* and the other being a second compression stage 30*b*, the vapor injection line 64 communicates with refrigerant line interconnecting the outlet of the first compression stage 30*a* to the inlet of the second compression stage 30*b*. In an embodiment where the compressor 30 comprises a single compressor having a first compression stage 30*a* feeding a second compression stage 30*b*, the refrigerant vapor injection line 64 may open directly into an intermediate stage of the compression process through a dedicated port opening into the compression chamber. It should be understood that the transport refrigeration system 20 illustrated and described herein is intended as an example only and that a transport refrigeration system including additional components is also within the scope of the disclosure.

With reference now to FIGS. 3A-4C, various examples of the flash tank 60 are provided in more detail. As shown, the flash tank includes an assembly 70 comprising a first or inlet header 72 fluidly connected to the valve 65 via refrigerant line 64, a second or outlet header 74 fluidly connected to valve 55 via refrigerant line 24. The assembly 70 further includes a plurality of modular tanks or vessels 76 fluidly coupled to the first header 72 and the second header 74. Although embodiments including two tanks, three tanks, and four tanks, are illustrated in the FIGS., it should be understood that an assembly 70 having any suitable number of tanks 76, including more than four tanks, is within the scope of the disclosure. The plurality of tanks 76 are connected to each of the headers 72, 74 such that the pressure, and the liquid and vapor distribution is balanced between each of the plurality of tanks 76.

In the illustrated, non-limiting embodiments, each of the plurality of modular tanks 76 has a substantially identical configuration, such as size and shape for example. In such embodiments, the total size of each of the plurality of tanks 76 is determined in part by the total number of tanks in the assembly 70. For example, if the flash tanks in combination require a total volume A, each tank 76 may be sized to have a volume equal to the total volume A divided by the total number of tanks 76 in the assembly 70. As a result, the pressure acting on the walls of each tank 76 is substantially less than in embodiments having a single tank defining the total volume A. Because of this reduced pressure, the tank 76 may be formed from a copper or aluminum material. In some embodiments, one or more of the plurality of tanks may be formed by a standard tube or conduit. However, in other embodiments, the assembly 60 may include tanks 76 having varying volumes as long as the load within each of the tanks 76 remains balanced. It should be understood that in an embodiment, the total volume A is a critical design consideration. For example, the total volume A is selected based on both the heat exchangers and the refrigerant charge mass to ensure that the pressure within the volume A can be maintained within acceptable operational limits across the full operational profile of the system. In addition, the volume A must be sized to keep the phase separation pressure, also referred to herein as flash pressure, within the tanks 76 sufficiently high to motivate the flow through the first header 64 to the second compression stage 30*b*.

Figure 4A:
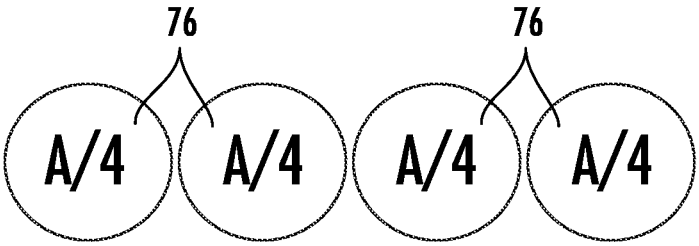
FIGS. 4A-4C are plan views of the plurality of tanks within various exemplary flash tank assemblies according to various embodiments.
Figure 4B:
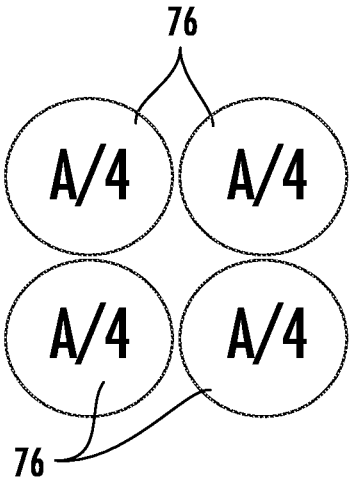
Figure 4C:
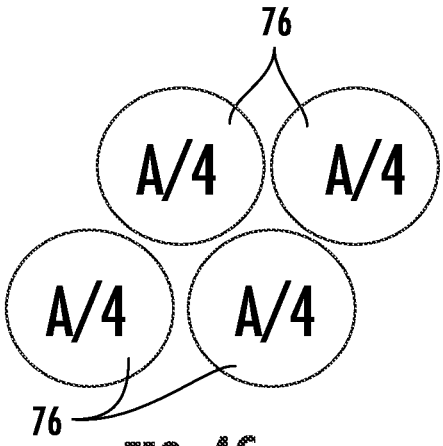

The plurality of tanks 76 may be mounted in varying configurations. For example, as shown in FIG. 4A, the plurality of tanks 76 may be mounted vertically in a linear configuration. Alternatively, the plurality of vertically oriented tanks 76 may be arranged in a plurality of rows, and the tanks in adjacent rows may be either aligned with one another (FIG. 4B), or staggered relative to one another (FIG. 4C).

By using several smaller tanks or vessels instead of a single large tank, the restrictive burst pressure requirements of the large vessel may be avoided. As a result, the tank may be fabricated from copper or aluminum instead of steel, thereby eliminating the need to braze dissimilar metals, improving the reliability of the welds. Further, by making a modular system where the total number of tanks 76 may be easily adjusted, the circuitry associated with the assembly 70 may remain the same between various configurations of the assembly, such as between each of the embodiments shown in FIGS. 3A-3C. Accordingly, a system including a flash volume defined by a plurality of modular tanks 76 provides a greater degree of design flexibility for future system configurations.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A refrigerant vapor compression system comprising:

a refrigerant circuit comprising a compressor, a heat rejection heat exchanger, a heat absorption heat exchanger, and a main expansion device arranged between the heat rejection heat exchanger and the heat absorption heat exchanger relative to a flow of refrigerant;

a secondary expansion device disposed downstream from the heat rejection heat exchanger; and a flash tank assembly disposed downstream from the heat rejection heat exchanger, the flash tank assembly comprising:

a first header arranged downstream from and in fluid communication with the second expansion device;

a second header arranged upstream from and in fluid communication with the main expansion device; and a plurality of tanks, each of the plurality of tanks having a respective inlet end arranged at a first end and an outlet end arranged at a second end, wherein the inlet end of each of the plurality of tanks is separately fluidly connected to the first header and the outlet end of each of the plurality of tanks is separately fluidly connected to the second header, wherein a load of the flash tank assembly is equally balanced between each of the plurality of tanks.

2. The refrigerant vapor compression system of claim 1, wherein each of the plurality of tanks is substantially identical.

3. The refrigerant vapor compression system of claim 1, wherein the plurality of tanks are formed from a copper material.

4. The refrigerant vapor compression system of claim 1, wherein the plurality of tanks are formed from an aluminum material.

5. The refrigerant vapor compression system of claim 1, wherein at least one of the plurality of tanks is a tube.

6. The refrigerant vapor compression system of claim 1, wherein the plurality of tanks extend vertically between the first header and the second header.

7. The refrigerant vapor compression system of claim 6, wherein the plurality of tanks are arranged in a linear configuration.

8. The refrigerant vapor compression system of claim 6, wherein the plurality of tanks are arranged in rows and the tanks within adjacent rows are aligned.

9. The refrigerant vapor compression system of claim 6, wherein the plurality of tanks are arranged in rows and the tanks within adjacent rows are staggered.

10. The refrigerant vapor compression system of claim 1, wherein the compressor comprises a single compressor having a plurality of compressor stages.

11. The refrigerant vapor compression system of claim 1, wherein the compressor further comprises a plurality of compressors arranged in series relative to the flow of refrigerant.

12. A flash tank assembly for a refrigerant vapor compression system, the refrigerant vapor compression system comprising a refrigerant circuit comprising a compressor, a heat rejection heat exchanger, a heat absorption heat exchanger, the flash tank assembly disposed downstream from the heat rejection heat exchanger, the flash tank assembly comprising:

a first header arranged downstream from and in fluid communication with a second expansion device of the vapor compression system;

a second header arranged upstream from and in fluid communication with a main expansion device of the vapor compression system; and a plurality of tanks, each of the plurality of tanks having a respective inlet end arranged at a first end and an outlet end arranged at a second end, wherein the inlet end of each of the plurality of tanks is separately fluidly connected to the first header and the outlet end of each of the plurality of tanks is separately fluidly connected to the second header, wherein a load of the flash tank assembly is equally balanced between each of the plurality of tanks.

13. The flash tank assembly of claim 12, wherein each of the plurality of tanks is substantially identical.

14. The flash tank assembly of claim 12, wherein the plurality of tanks are formed from a copper material.

15. The flash tank assembly of claim 12, wherein the plurality of tanks are formed from an aluminum material.

16. The flash tank assembly of claim 12, wherein at least one of the plurality of tanks is a tube.

17. The flash tank assembly of claim 12, wherein the plurality of tanks extend vertically between the first header and the second header.

18. The flash tank assembly of claim 17, wherein the plurality of tanks are arranged in a linear configuration.

19. The flash tank assembly of claim 17, wherein the plurality of tanks are arranged in rows and the tanks within adjacent rows are aligned.

20. The flash tank assembly of claim 17, wherein the plurality of tanks are arranged in rows and the tanks within adjacent rows are staggered.

* * * * *